US008221144B1

(12) United States Patent
Williams et al.

(10) Patent No.: US 8,221,144 B1
(45) Date of Patent: Jul. 17, 2012

(54) PARTIAL DISCHARGE RESISTANT CONNECTOR

(75) Inventors: Roger Williams, Santa Rosa, CA (US); Christopher Hankins, Petaluma, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 13/068,116

(22) Filed: May 3, 2011

(51) Int. Cl.
*H01R 13/53* (2006.01)

(52) U.S. Cl. ..... 439/181; 439/879

(58) Field of Classification Search ..... 439/181, 439/877, 879
See application file for complete search history.

(56) References Cited

U.S. PATENT DOCUMENTS

| | | | |
|---|---|---|---|
| 3,916,085 | A | 10/1975 | Hansen |
| 5,562,497 | A | 10/1996 | Yagi et al. |
| 5,662,480 | A | 9/1997 | Togashi |
| 5,707,253 | A | 1/1998 | Matsumoto et al. |
| 6,033,260 | A | 3/2000 | Murata et al. |
| 6,232,555 | B1 | 5/2001 | Besler et al. |
| 6,257,931 | B1 | 7/2001 | Sakurai et al. |
| 7,422,480 | B1 | 9/2008 | Musick et al. |
| 7,467,896 | B2 | 12/2008 | Melton et al. |
| 7,598,455 | B2 | 10/2009 | Gump et al. |
| 7,726,985 | B2 | 6/2010 | Gladd et al. |
| 7,731,536 | B2 | 6/2010 | Okayasu |
| 7,901,246 | B2 | 3/2011 | Takayama |

FOREIGN PATENT DOCUMENTS

| | | |
|---|---|---|
| JP | 2009-123647 | 4/2009 |
| JP | 2010-129288 | 10/2010 |
| WO | WO 2006/005398 | 1/2006 |

*Primary Examiner* — Ross Gushi
(74) *Attorney, Agent, or Firm* — Leon D. Rosen

(57) ABSTRACT

A high voltage connector, such as one that carries current at a voltage of at least one kilovolts, is constructed to minimize partial discharge (a small amount of current flow) out of locations where a cable conductor has been crimped to the rear of a contact, which resulted in sharp points or edges. A shroud is mounted around the connector, which includes a cylindrical shroud sleeve lying around the crimped region of the contact, with the rear end of the shroud sleeve having rounded edges or abutting a rear shroud element, and with the front end of the shroud preferably being of hemispheric shape.

8 Claims, 3 Drawing Sheets

PARTIAL DISCHARGE RESISTANT CONNECTOR

BACKGROUND OF THE INVENTION

High voltage (at least one kilovolt) potentials tend to result in partial discharge in air voids between a contact and an adjacent shell or other part that is at a different voltage. The partial discharge occurs at locations on the contact or cable that have sharp edges as a result of crimping. The partial discharge can damage locations of the insulation adjacent to the location of the partial discharge by the creation of ozone, eventually leading to failure of the insulation. Such sharp (small radius of curvature) locations are commonly formed when a contact is crimped to a cable conductor. A system that avoided such leakage would be of value.

SUMMARY OF THE INVENTION

In accordance with one embodiment of the invention, a shroud is placed around an area of a contact that has been crimped around a cable conductor or the like. The shroud is in electrical engagement with the contact. The shroud has an outer surface that is curved to avoid the discharge of electricity from the area of the contact.

In one connector, the contact has a rear crimped part that is crimped to an inner conductor of an electrical cable, and has a separate contact front mating part that projects forward from the crimped rear part. The shroud has a hole that the front mating part extends through. A screw extends through the front mating part and threadably engages the crimped rear part. When the screw is tightened, the parts are trapped in place.

The shroud has a cylindrical tubular rear portion and has a front end in the form of a hemisphere to avoid partial discharge. In one shroud system, the rear end of the tubular portion has rounded rear edges. In another shroud system, the rear end of the of the shroud tubular portion abuts the front end of another shroud that has a hemispherical rear end.

The novel features of the invention are set forth with particularity in the appended claims. The invention will be best understood from the following description when read in conjunction with the accompanying drawings.

DETAILED DESCRIPTION OF THE INVENTION

Figure 1:
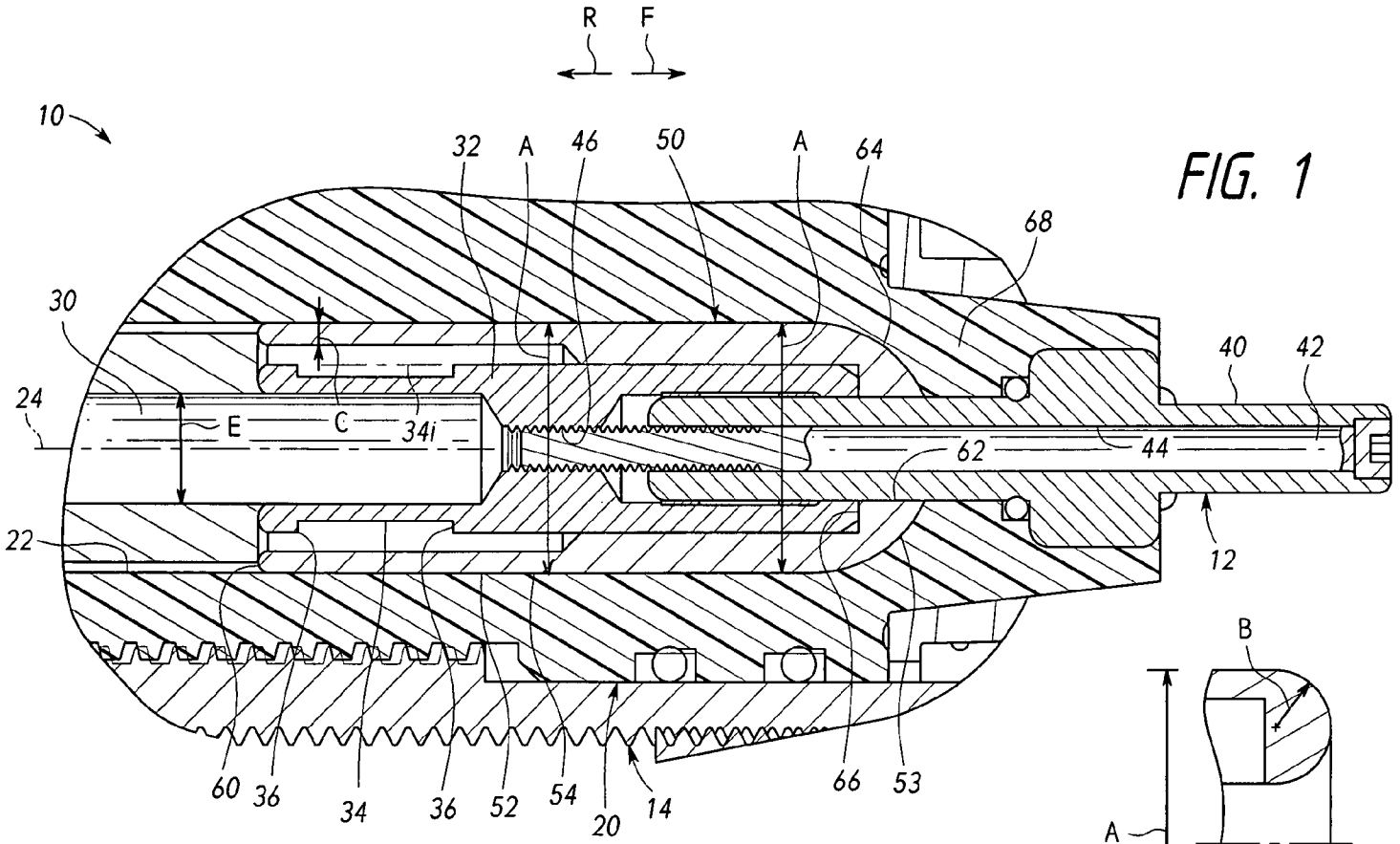
FIG. 1. Is a sectional view of a portion of a high voltage connector that includes a pin contact, showing a shroud arrangement of one embodiment of the invention.

FIG. 1 shows a high voltage (at least one kilovolt) connector 10 that has at least one contact 12, that has a metal shell 14 that extends around the contact, and that has a main insulator 20 lying between the contact and shell. The main insulator 20 has at least one through passage 22 that extends in front F and rear R directions along a passage axis 24. The contact is terminated to the front end of a cable inner conductor 30, by a crimp part 32 of the contact that is crimped to the cable conductor. The crimp part initially had a cylindrical outer surface at 34*i*, but this area 34*i* has been radially inwardly deformed into the recess 34 that is illustrated. The usual result of crimping is that sharp edges, that is, edges of small radius of curvature, are formed as at 36. Because of the high voltage difference (usually at least one kilovolt) between the potential of the connector crimp part 32 and the potential of the shell 14 (which is usually grounded), electricity tends to be discharged from the sharp edge, to flow through the insulator 20 to the metal shell 14. Partial discharge can occur in even the smallest air spaces, and such discharge tends to create ozone and damage the insulation.

The contact 12 of FIG. 1 is a male or pin contact, which includes a forwardly projecting part 40 that is intended to engage a socket contact. A machine screw 42 extends through a passageway 44 in the contact projecting part 40 and is threadably engaged with a threaded hole 46 in the contact crimp part 32, to hold the parts together.

Applicant minimizes partial discharge of the contact 12 by the addition of an electrically conductive shroud 50. The shroud has a rear portion 52 with a cylindrical outer surface 54 of diameter A and radius A/2 and has a front portion 56 with an outer surface 58 in the form of a hemisphere of the same radius A/2. The hemispherical surface is curved about the contact axis 24 and about axes that are angled from the contact axis 24, including axes that are perpendicular to the contact axis. The radius of curvature of the hemisphere and of the cylindrical surface 54 of the shroud tubular portion are preferably at least as large as the radius of the outside of the contact crimp part 32.

Figure 1A:
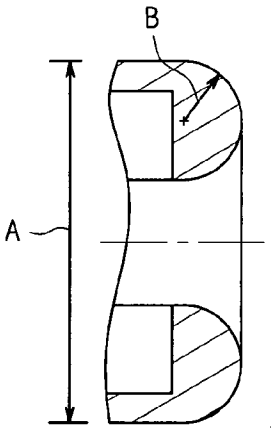
FIG. 1A is a sectional view of a shroud front end of another embodiment of the invention.
Figure 1B:
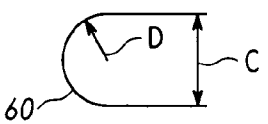
FIG. 1B is an enlarged view of a portion of the shroud of FIG. 1.

The rear edge 60 of the shroud has a limited wall thickness C. As shown in FIG. 1B, the rear edge 60 of the shroud is curved about a maximum radius of curvature D that is approximately half the wall thickness. This results in less current leakage than a sharp edge, although a larger radius of curvature would be desirable.

The shroud 50 has a through hole 62 (FIG. 1) that extends through the hemispherical front portion 53 of the shroud. The contact front projecting part 40 projects through the hole 62, with a close fit (no more than 1% clearance between them). However, to bridge any gap resulting from such tolerances, the front end 64 of the crimp part 32 is drawn forward against an internal surface 66 of the shroud front end as the screw is tightened. In addition, the shroud front end presses forwardly against the insulator at 68.

Applicant has designed a connector of the type illustrated in FIG. 1, for a high voltage-high current system with a cable inner conductor 30 of a diameter E of 0.5 inch. The shroud 50 had an outside diameter A of 0.813 inch. The rear edge 60 of the shroud tubular portion had a wall thickness of 1.7 millimeters and a radius of curvature of 0.8 mm.

Although applicant prefers the large radius of curvature produced by the hemisphere, other shapes can be used. FIG. 1A shows a shroud front end with a radius of curvature B that is one-sixth the outside diameter A of the shroud, which is still large enough to avoid partial discharge even though it is less than the radius of curvature of A/2 in FIG. 1.

Figure 2:
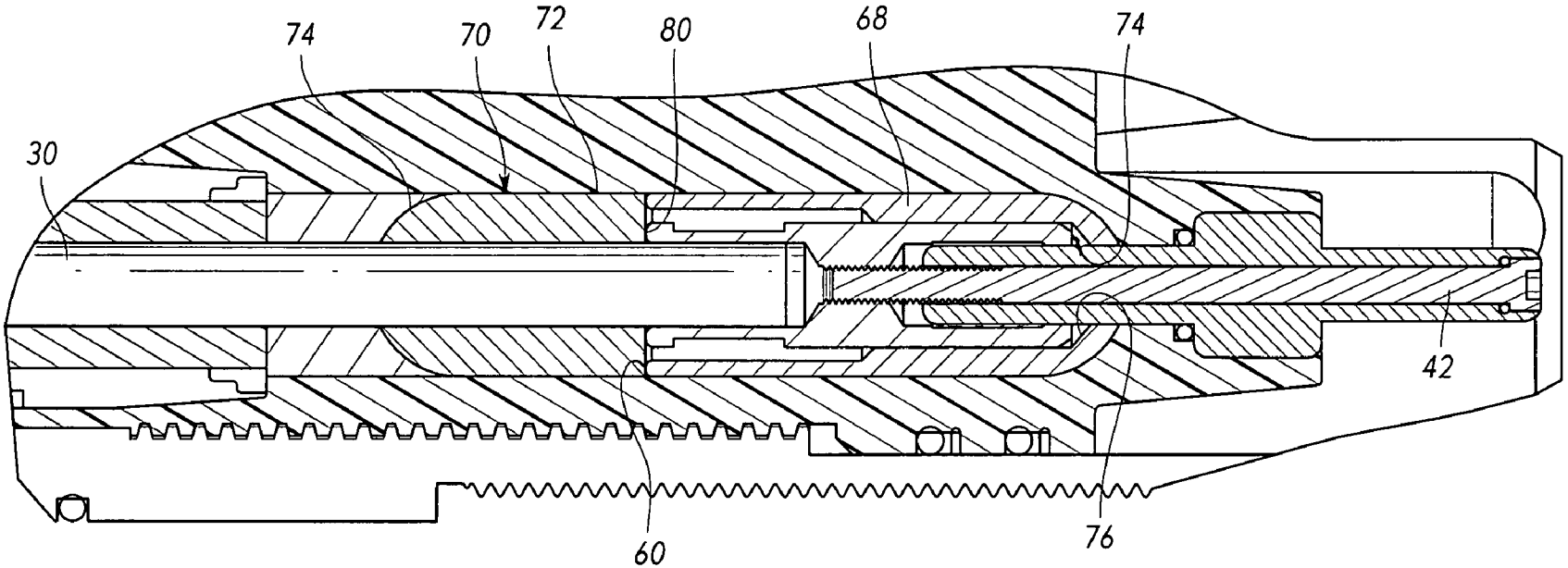
FIG. 2 is a sectional view of a portion of a high voltage connector that includes a pin contact, showing a shroud arrangement of another embodiment of the invention.

FIG. 2 illustrates a high voltage connector that is similar to that of FIG. 1 and with a front shroud 68 similar to that of FIG. 1, except that a rear shroud element 70 is provided at the rear of the front shroud 68. The rear shroud element has a cylindrical front portion 72 and a hemispherical rear portion 74, both with a large radius of curvature that is at least 10% of the shroud outside diameter. The rear end 60 of the front shroud abuts the flat front surface 80 of the rear shroud element. When the screw 42 is tightened, it not only draws the crimp part against the inside of the shroud front end, but pulls on the cable conductor 30, which draws the front shroud and the rear shroud element together. In FIG. 2, the crimp part front end 74 is circular and abuts a tapered inside surface 76 of the shroud.

Figure 3:
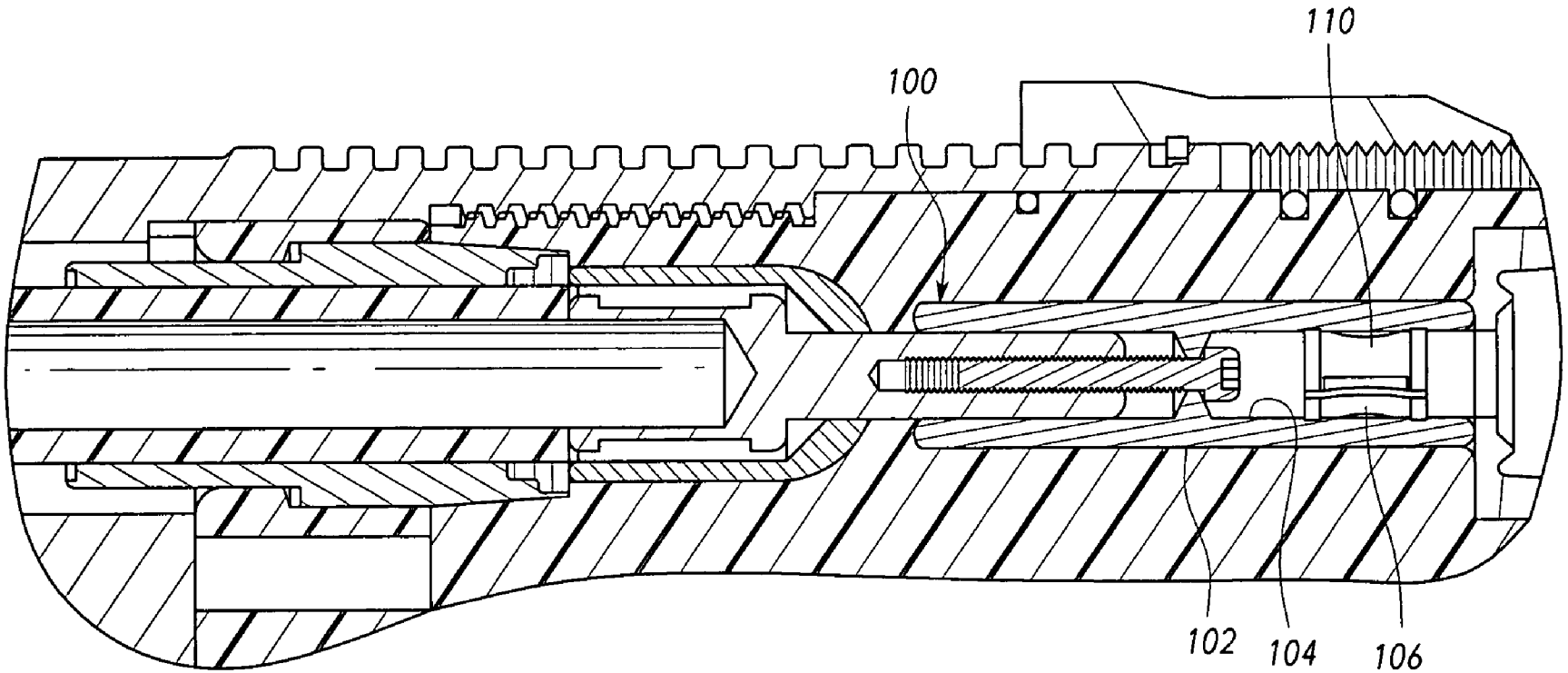
FIG. 3 is a sectional view of a portion of a high voltage connector that includes a socket contact, showing a shroud arrangement of another embodiment of the invention.

FIG. 3 shows a high voltage connector with a socket contact 100. The front projecting part 102 of the connector has a passageway 104 that holds a contactor 106 formed by a rectangular piece of sheet metal bent into a cylinder, with the middle 110 bent inwardly.

Thus, the invention provides a high voltage connector that includes a contact with a crimp part that is crimped to a cable inner conductor, and that is surrounded by a (usually grounded) metal shell. The contact is provided with a shroud that resists partial discharge in the air space surrounding the sharp edges formed by the crimp and a surrounding shell. The shroud includes a tubular rear portion and a curved front portion that is preferably of hemispherical shape. The rear edge of the tubular portion of the front shroud can be rounded, and/or a rear shroud element can be placed against the rear end of the front shroud.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A high voltage connector which includes a contact that has a contact axis, a contact rear end, and a forward projecting front mating end, said connector including a cable that has an inner cable conductor connected to said contact rear end, and said connector having a conductive shell that extends around said contact, wherein said contact has a crimp part (32) that is crimped around said axis to said inner cable conductor rear end, comprising:

a first shroud (50) that is mounted on said contact, said first shroud having a tubular rear portion (52) that extends about said axis and about said crimp part of said contact, said first shroud having a front end (53) in the form of a hemisphere with a hole (62) therein through which said contact front mating end projects.

2. The connector described in claim 1 wherein:

said first shroud tubular rear portion has a predetermined wall thickness (C), and said tubular rear portion has a rear end (60) with a radius of curvature (D) equal to half said wall thickness.

3. The connector described in claim 1 including:

a rear second shroud element (70) that has a cylindrical outer surface (72) with a front end (72) that abuts said first shroud tubular rear end and that has a hemispherical rear end (74).

4. The connector described in claim 1 including:

isolation means (68) that abuts said front end of said shroud;

a screw (42) that extends along said contact axis and that engages said crimp part (32) of said contact;

said first shroud has a front end with an abutting internal surface (66) that lies forward of said crimp part, and said crimped part has a circular front end (64), so as said screw is tightened it draws said front end of said crimped part against said abutting internal surface to assure good contact between them.

5. The connector described in claim 4 wherein:

said first shroud abutting surface is a tapered internal surface (76) that lies forward of said crimped part to be of progressively smaller diameter at progressively more forward locations therealong.

6. A high voltage connector which includes a metal shell (14), an insulator (20) that lies in the shell and that has at least one through passage (32) that extends along a passage axis (24), and a contact (12) that lies in said passage and that has a crimp rear end part (32) that is crimped (36) around a cable high voltage inner conductor (30), and that has a crimp front end portion (40) that projects forward of said rear end part and that is designed to mate with another contact, including:

a conductive shroud (50) that has a tubular rear portion (52) that is centered on said passage axis and that extends around said crimp rear end part (32), said shroud having a front portion (53) of predetermined diameter (A) about said passage axis and that is curved about at least one axes that is angled to said passage axis, with a radius of curvature (A/2, B) about each of said axes being at least 10% of said predetermined diameter.

7. The connector described in claim 6, wherein:

said front portion (53) of said shroud has an outside in the shape of a hemisphere and has an internal surface (66, 76); and has a shroud hole (62) lying on said axis; and including a screw (42) that extends along said passage axis through said shroud hole and that is threadably connected to said crimp part (32) of said contact, so when said screw is tightened it draws said crimp part of said contact against said internal surface of said front portion of said shroud.

8. The connector described in claim 6 including:

a shroud element (70) that has a cylindrical front portion (72) of the same diameter as said shroud tubular rear portion and that abuts a rear end (60) of said shroud tubular rear portion, said shroud element having a rear end (74) that is curved about at least one axis that is angled from said passage axis, about a radius of curvature that is at least 10% of said predetermined diameter.

* * * * *